US011745837B2

(12) United States Patent
Zierke

(10) Patent No.: US 11,745,837 B2
(45) Date of Patent: Sep. 5, 2023

(54) MODULAR STORAGE STRUCTURE FOR POSITIONING IN A BODY OF WATER

(71) Applicant: Zierke Innovative Industries, LLC, Fairmont, MN (US)

(72) Inventor: Gregory M. Zierke, Fairmont, MN (US)

(73) Assignee: Zierke Built Manufacturing, Inc., Fairmont, MN (US)

( * ) Notice: Subject to any disclaimer, the term of this patent is extended or adjusted under 35 U.S.C. 154(b) by 181 days.

(21) Appl. No.: 17/170,303

(22) Filed: Feb. 8, 2021

(65) Prior Publication Data

US 2021/0245849 A1 Aug. 12, 2021

Related U.S. Application Data

(60) Provisional application No. 62/970,976, filed on Feb. 6, 2020.

(51) Int. Cl.

| | |
|---|---|
| ***B63B 35/44*** | (2006.01) |
| ***B63B 1/04*** | (2006.01) |
| ***B63B 13/00*** | (2006.01) |
| ***B63B 21/50*** | (2006.01) |

(52) U.S. Cl.

CPC ..... *B63B 35/44* (2013.01); *B63B 1/04* (2013.01); *B63B 13/00* (2013.01); *B63B 21/502* (2013.01); *B63B 2209/18* (2013.01)

(58) Field of Classification Search

CPC ..... B63B 35/44; B63B 1/04; B63B 13/00; B63B 21/502; B63B 2209/18; B63B 77/00; E02B 3/20; E04H 1/1205

See application file for complete search history.

(56) References Cited

U.S. PATENT DOCUMENTS 3,785,312 A * 1/1974 Schneider ..... B63B 35/00 114/266

4,190,013 A * 2/1980 Otis ..... B63C 3/06 414/253

(Continued)

*Primary Examiner* — Anthony D Wiest

(74) *Attorney, Agent, or Firm* — Peter J. Ims; Westman, Champlin & Koehler, P.A.

(57) ABSTRACT

A storage structure is configured to be buoyant or retained above a water line. The storage structure includes a frame having a back beam, a left beam attached to the back beam, a right beam attached to the back beam and a front beam attached to the left beam and the right beam to form a substantially rectangular configuration, wherein prior to a last of the beams being secured together an interior space accessible through an opening. The storage structure includes a bladder configured to be positioned through the interior space though the opening wherein the bladder is sized to be retained within the interior space whether the storage structure is above the water line or buoyant, the bladder including a vent, a fill port and a drain wherein an amount of water within the bladder is manipulated to provide ballast or buoyancy to the storage structure. The storage structure includes at least one floor panel secured to the frame over the bladder, side walls extending from a perimeter of the floor panel, wherein one side wall includes a door for ingress and egress to the storage structure. The storage structure includes a roof attached to the side walls.

21 Claims, 8 Drawing Sheets

(56) References Cited

U.S. PATENT DOCUMENTS

| | | | | |
|---|---|---|---|---|
| 7,216,603 | B2 * | 5/2007 | Towley, III | B63B 35/44<br>114/344 |
| 2012/0102871 | A1 * | 5/2012 | Randall | E04B 1/34321<br>52/745.13 |
| 2013/0047527 | A1 * | 2/2013 | Vogl | E04H 1/1205<br>52/234 |

* cited by examiner

MODULAR STORAGE STRUCTURE FOR POSITIONING IN A BODY OF WATER

CROSS REFERENCE TO RELATED APPLICATION(S)

The present application claims the benefit of U.S. Provisional Patent Application Ser. No. 62/970,976 entitled MODULAR STORAGE STRUCTURE FOR POSITIONING IN A BODY OF WATER that was filed on Feb. 6, 2020, the contents of which is incorporated by reference in its entirety.

BACKGROUND

The present disclosure relates to a modular storage structure that is configured to be assembled and positioned in a body of water. More particularly, the present disclosure relates to a modular storage structure that can be assembled and positioned in a body of water proximate a dock or other structure configured to retain or lift a boat.

Many people enjoying boating activities on the water. These activities include fishing and other recreational activities, such as, but not limited to water skiing, water tubing and wakeboarding. Many of these activities require a significant amount of equipment. For instance, fishing requires fishing rods and reels, a tackle box, typically a landing net and in some instances a live bait bucket. Similarly, recreational water activities can require skis, tubes and wakeboards are required for water skiing, water tubing and wakeboarding. In all instances, life jackets or floatation devices are also required.

However, many people do not want to leave the equipment in their boats for extended periods of time. For instance, weather can adversely affect the equipment over time. Further, leaving equipment in an unattended boat increases the possibility of the equipment being taken or stolen.

As such, many people transport the equipment to the boat from a secure location, such as a house, cabin or outdoor shed when the equipment is used and back to the secure location after the equipment has been used. However, the transportation of the equipment to and from the boat can be time consuming and tiresome.

SUMMARY

An aspect of the present disclosure is directed to a storage structure configured to be buoyant or retained above a water line. The storage structure includes a frame having a back beam, a left beam attached to the back beam, a right beam attached to the back beam and a front beam attached to the left beam and the right beam to form a substantially rectangular configuration, wherein prior to a last of the beams being secured together an interior space accessible through an opening. The storage structure includes a bladder configured to be positioned through the interior space though the opening wherein the bladder is sized to be retained within the interior space whether the storage structure is above the water line or buoyant, the bladder including a vent, a fill port and a drain wherein an amount of water within the bladder is manipulated to provide ballast or buoyancy to the storage structure. The storage structure includes at least one floor panel secured to the frame over the bladder, side walls extending from a perimeter of the floor panel, wherein one side wall includes a door for ingress and egress to the storage structure. The storage structure includes a roof attached to the side walls.

Another aspect of the present disclosure includes a storage structure configured to be buoyant or retained above a water line the storage structure. The storage structure includes a frame with a back beam, a left beam attached to the back beam, a right beam attached to the back beam, and a front beam attached to the left beam and the right beam to form a substantially rectangular configuration, wherein prior to a last of the beams being secured together an interior space accessible through an opening. The storage structure includes a bladder configured to be retained within the interior space of the frame, the bladder including a vent, a fill port and a drain wherein an amount of water within the bladder configured to is manipulated to provide ballast or buoyancy to the storage structure. The storage structure includes at least one floor panel supported by the frame over the bladder, side walls extending from a perimeter of the floor panel, wherein one side wall includes a door for ingress and egress to the storage structure, and a roof attached to the side walls. The storage structure includes a plurality of legs extending from the frame, each of the plurality of legs being independently adjustable in length, wherein when the plurality of legs is in a first position, the legs support the structure above the water line and wherein when the plurality of legs is in a second position, the bladder provides buoyancy to the structure to maintain the structure afloat.

DETAILED DESCRIPTION

Figure 1:
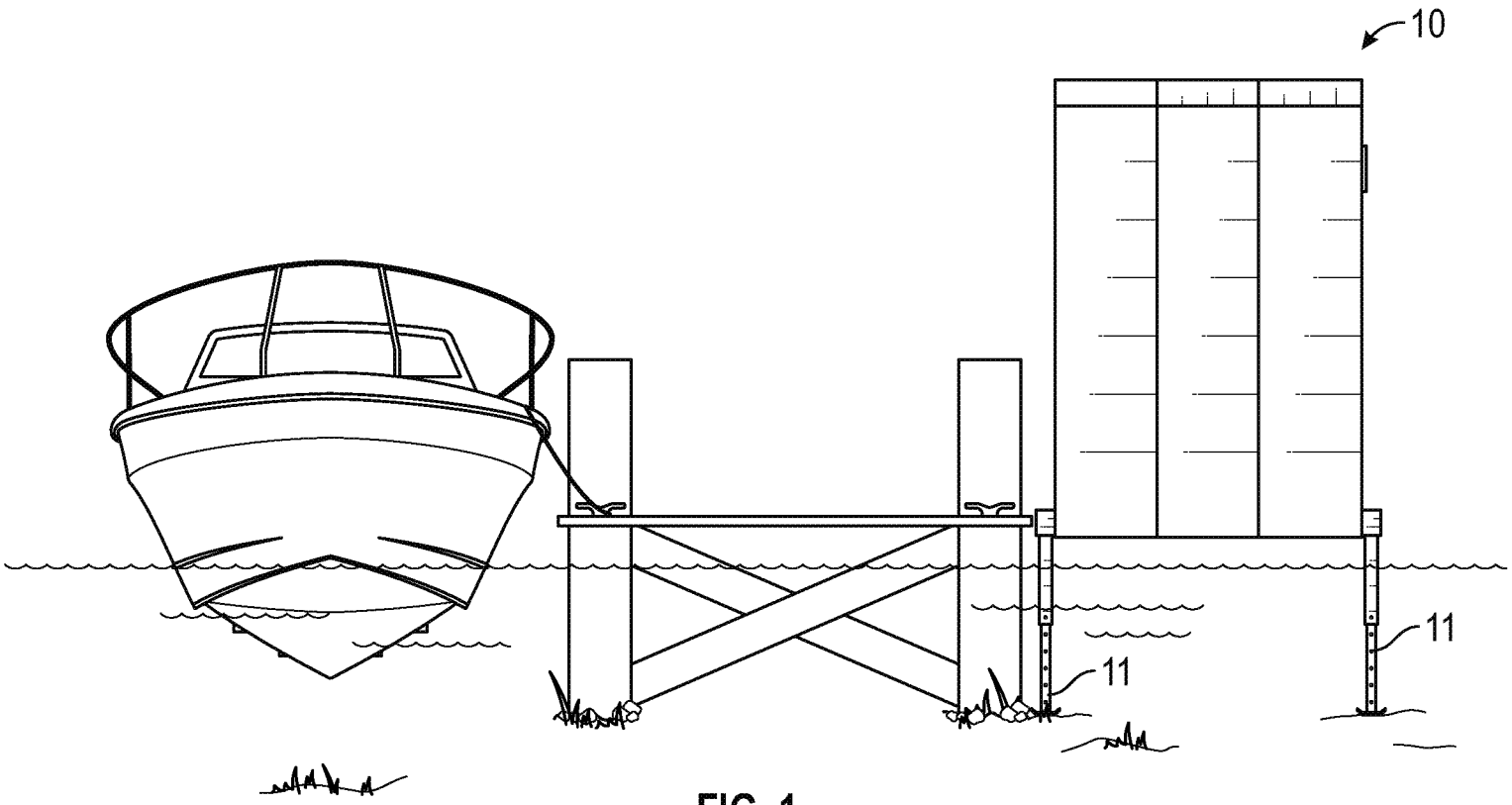
FIG. 1 is a perspective view of a storage structure supported by legs above a body of water by a dock.
Figure 2:
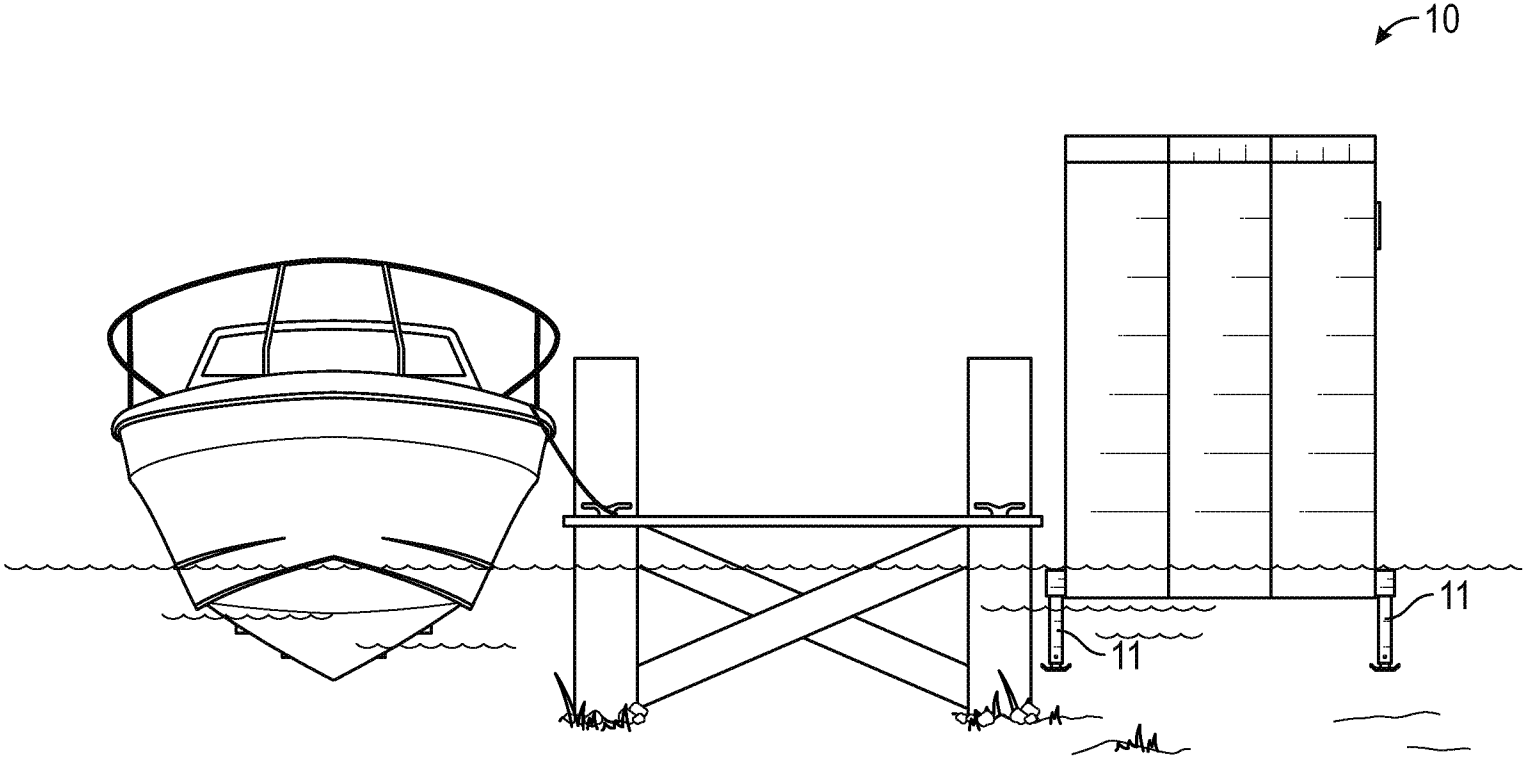
FIG. 2 is a perspective view of the storage structure floating on the body of water and secured to a dock.

The present disclosure is directed to a modular storage structure that is configured to be installed proximate a dock, a pier or a boat lift. Once constructed, the storage structure is positioned in a body of water proximate the dock, pier or boat lift to provide a structure for securely storing equipment that is used while on a boat, dock or pier. The storage structure 10 can be retained above a water level with a plurality of legs 11, as illustrated in FIG. 1. The storage structure 10 can also be configured to float on the water with the use of a bladder that interfaces with the water while secured to the dock or pier, as illustrated in FIG. 2. However, the storage structure is placed or installed in the body of water, the storage structure provides a secure space for storing equipment that is used on the boat, dock or pier that normally would have to be taken back and forth from a secure location, such as a house or building located on land, and back to the boat, dock or pier for each use.

Referring to FIGS. 3-6, 8A and 8B, the storage structure 10 includes a frame 12 that includes a back beam 14 that connects to a left side beam 16 and a right side beam 18. Each of the beams 14, 16 and 18 have a "C" shaped cross-section such that when the beams 14 and 16 and the beams 14 and 18 are secured together with nuts and bolts, the beams 14, 16 and 18 form a "U" shaped structure with upper and lower surfaces extending inwardly with a substantially flat outer surface. While nuts and bolts are disclosed, other securing members for connecting the beams 14, 16, 18 are also contemplated, including but not limited to welds and interlocking surfaces, such as those formed by an extrusion or molding process. While a "C" shaped cross-sectional beams are disclosed and illustrated, any suitable cross-sectional members can be utilized including, but not limited to, tubular members, I-beams or combinations thereof.

A plurality of joists 20 is secured to the left side beam 16 and the right side beam 18. The plurality of joists 20 is substantially uniformly spaced apart and provide rigidity to the frame 12 by retaining the left and right side beams 16 and 18 in a substantially parallel orientation. The plurality of joists 20 also provide support for a bladder 30 that is installed below a floor of the storage structure 10.

The bladder 30 is installed within the frame 12 through an opening 22 in the frame 12, where the opening 22 is opposite the back beam 14. The bladder 30 has a width that is slightly less than a length of the back beam 14 such that the bladder can be positioned within the opening 22. The bladder 30 has a length that is approximately a length of the left and right side beams 16 and 18 such that the bladder 30 is retained within the "U" shaped structure of the frame 12.

Once the bladder 30 is positioned within the frame 12, a front end beam 24 is fixedly secured to the left and right side beams 16 and 18 with a weld or a bolt and nut connector, where the front end beam 24 is substantially "C" shaped in cross-section. However, other cross-sectional configurations of the front end beam 24 is within the scope of the present disclosure including, but not limited to a tubular cross-section and an I-beam cross-section. With the front end beam 24 secured to the left and right side beams 16 and 18, the frame 12 is substantially continuous which retains the bladder 30 within the frame 12 and prevents the bladder 30 being removed from the frame 12. While the bladder 30 is illustrated as being installed through the front end of the frame 12, the frame 12 can be constructed such that the bladder 30 can be installed through any side of the frame where the beam for the selected side is then secured to the frame 12 after the bladder 30 is installed.

In other embodiments, the front end beam 24 is removably secured to the left and right side beams 14 and 16, which allows the bladder 30 to be removed from the frame 12 and reinserted into the frame 12. In this alternative embodiment, the bladder 30 includes a plurality of handles to aid in manipulating the bladder 30 into and out of the frame 12.

Figure 3:
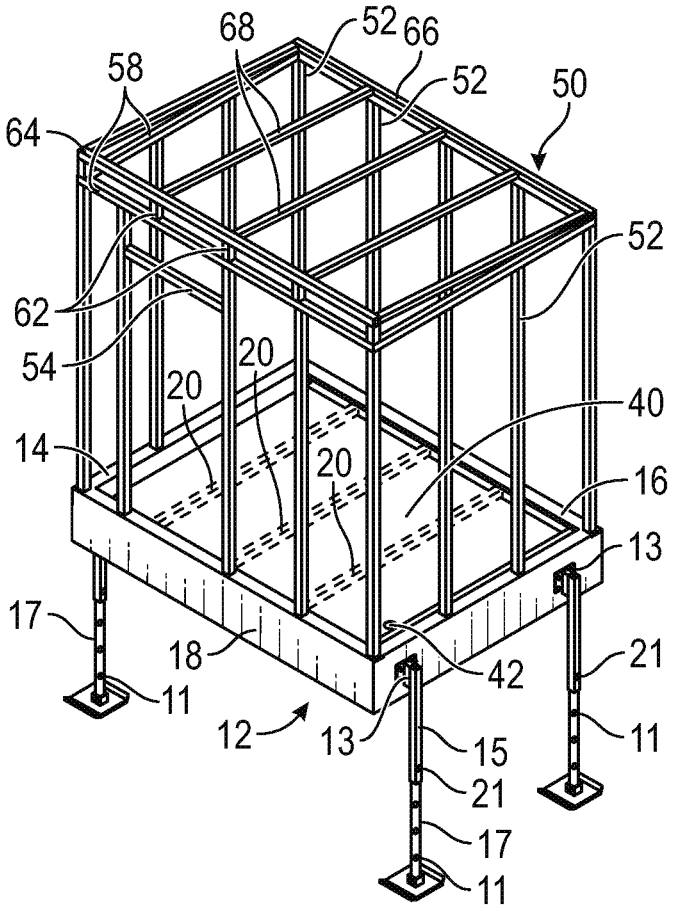
FIG. 3 is a perspective view of a skeleton of the storage structure of the present disclosure with a floor.
Figure 4:
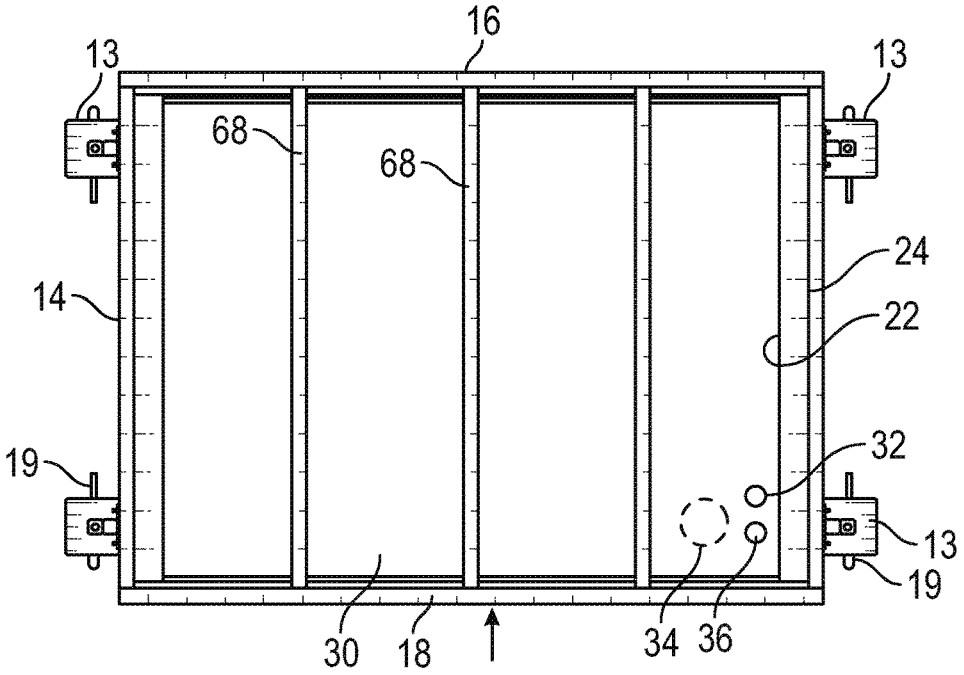
FIG. 4 is a top view of a skeleton retaining a bladder of the storage structure.
Figure 5:
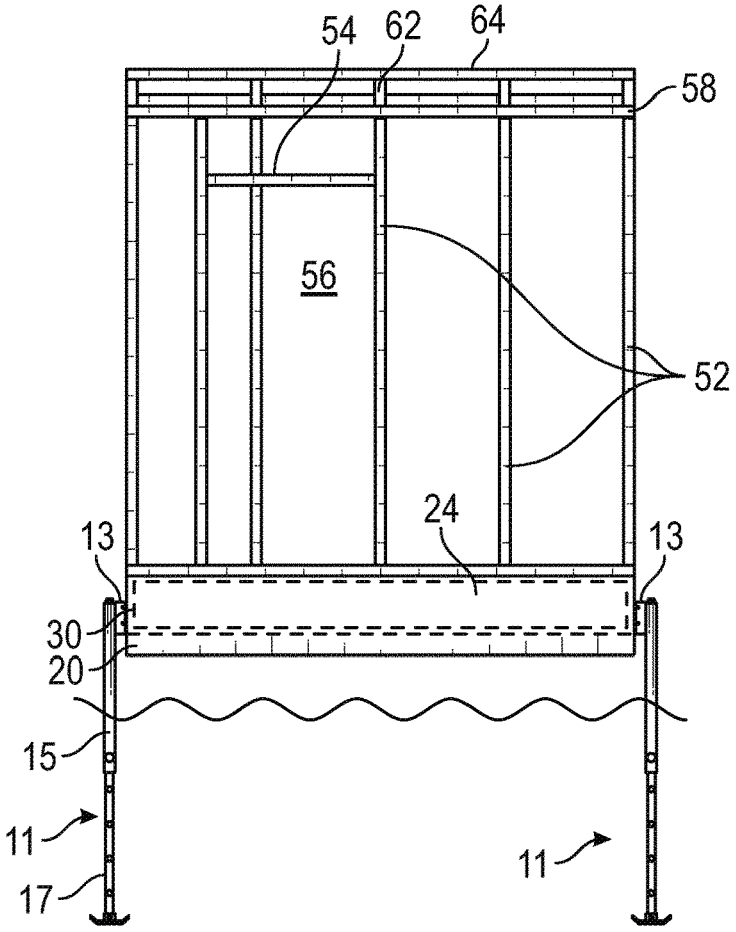
FIG. 5 is a front view of the skeleton of the structure.
Figure 6:
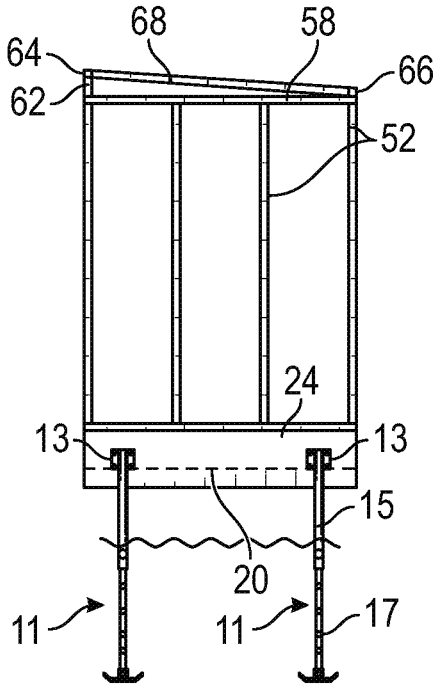
FIG. 6 is a side view of the skeleton of the structure.
Figure 7:
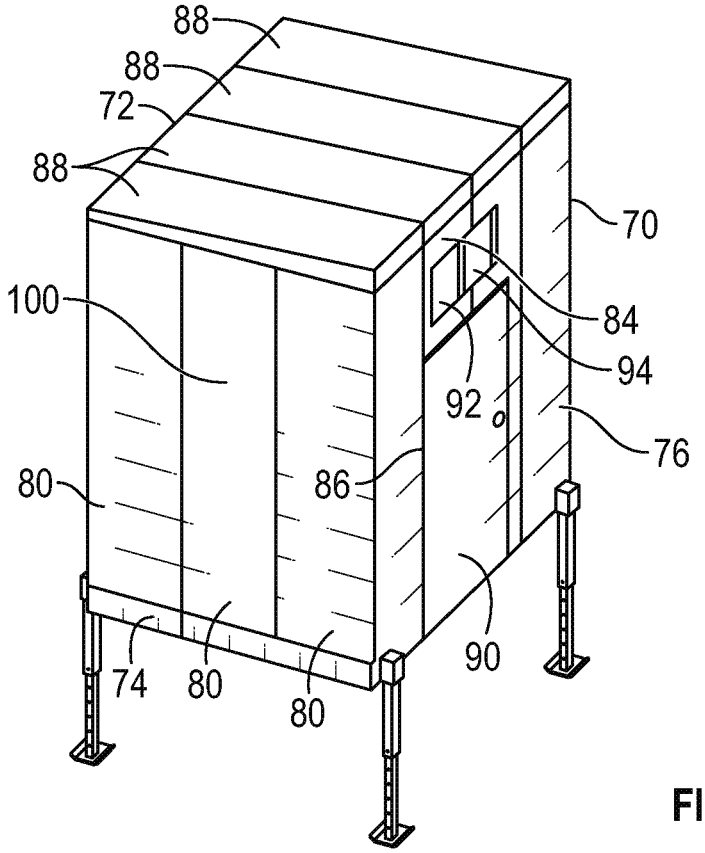
FIG. 7 is a perspective view of the storage structure with walls, a roof and a door.
Figure 8A:
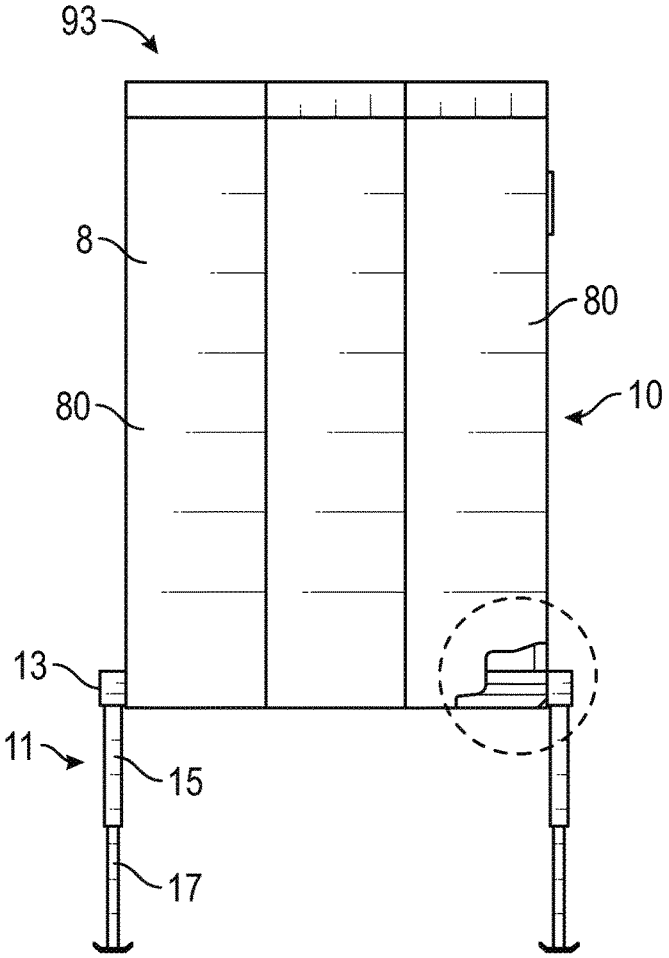
FIG. 8A is a side view front view of the storage structure.
Figure 8B:
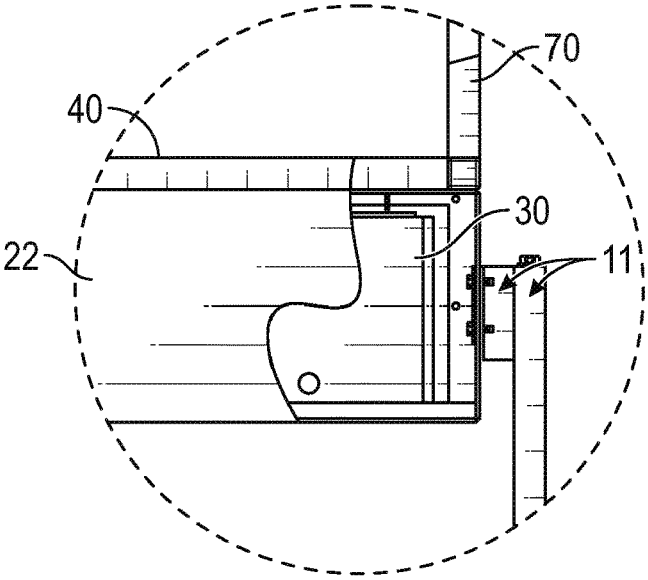
FIG. 8B is an enlarged view of the bladder within the frame of FIG. 8A
Figure 9:
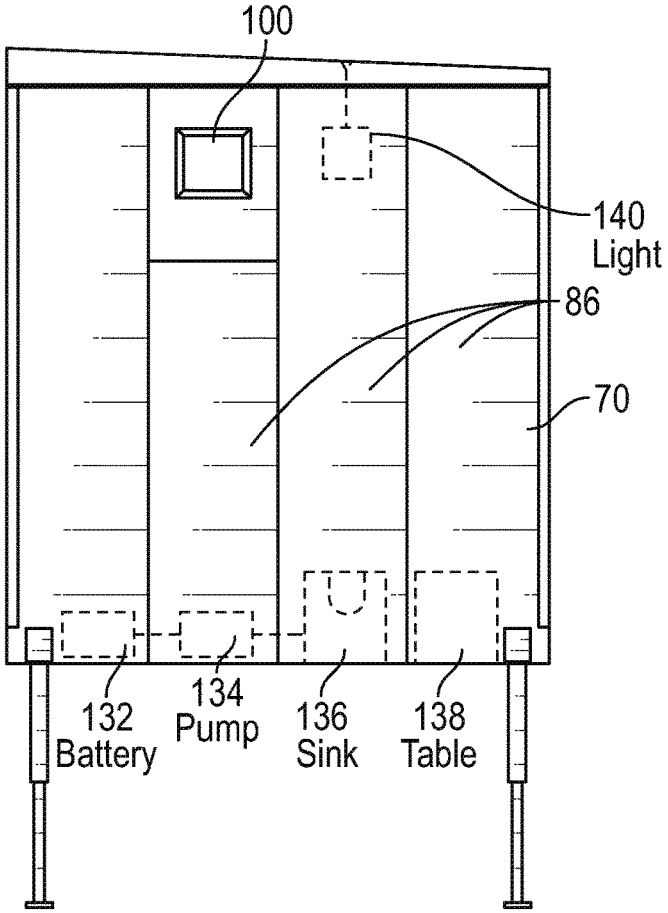
FIG. 9 is a side view of the storage structure.
Figure 10:
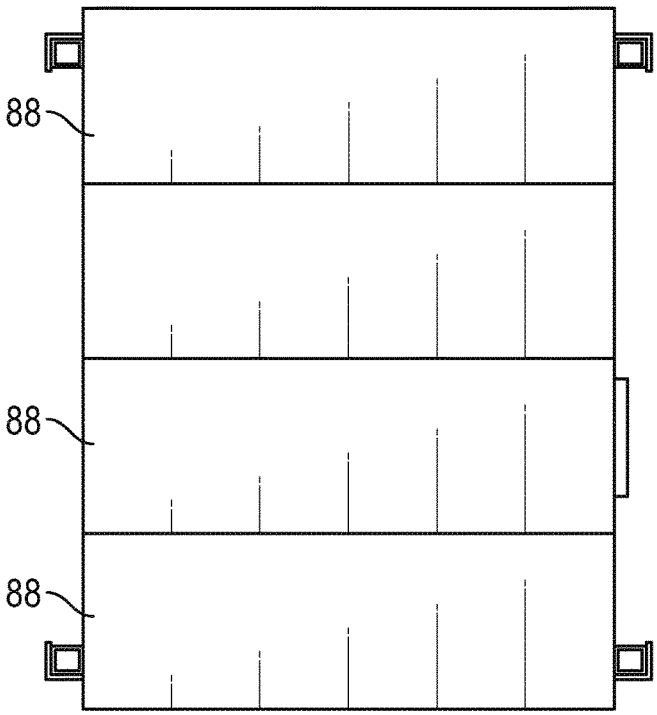
FIG. 10 is a top view of the storage structure.

In the embodiment disclosed in FIG. 1, where the storage structure is supported above the water of the body of water, a plurality of legs 11 support the shed. The plurality of legs 11 are secured to the frame 12 proximate the four corners thereof. Referring to FIG. 3, each leg 11 is similarly constructed and includes a mounting bracket 13 secured to an exterior surface of the frame 12, typically with bolts and nuts or a weld. An upper portion 15 of the leg 11 is fixedly secured to the mounting bracket 13. The upper portion 15 is typically tubular with an interior space extending from end to end. The leg 11 includes a lower portion 17 that telescopes within the upper portion 13 to adjust a length of each leg. Once each leg 11 is at a selected length where the frame 12 and the bladder 30 are above the waterline, the lower portion 17 is secure to the upper portion 15 with a pin 19 secured within aligned apertures 21 in the lower portion 17 and the upper portion 15.

While a pin 19 inserted through aligned apertures 21 is disclosed and illustrated, other retaining mechanism are within the scope of the present disclosure including set screws. The present disclosure can also utilize legs 11 where the length can be adjusted with an actuator, such as, but not limited to a threaded bolt that moves the lower portion 17 relative to the fixed upper portion 15.

The upper portion 15 typically includes a square or rectangular through bore that accepts the lower portion 17 having a complimentary configuration. The square or rectangular through bore in the upper portion 15 that accepts the exterior surface of the lower portion 17 prevent rotation of the lower portion 17 relative to the upper portion 15, which aids is aligning the apertures in the respective portions of the leg 11. While square or rectangular cross-sectional portions 15 and 17 are disclosed, the legs the portions 15 and 17 can be any complementary configuration include in polygonal, cross-sections with a single flat surface and a circular cross-section (where rotation of the leg within the bracket must be accounted for with a securing mechanism). However, it is also within the scope of the present disclosure to utilize circular cross-sectional tubular members for the legs 11 or to have a leg of a fixed length move within a receptacle of a mounting bracket attached to the frame 12 to adjust the length of each leg 11.

When the storage structure 10 is above the waterline, the bladder 30 is supported by the lower interior surfaces extending around a perimeter of the frame 12 and the plurality of joints 20. When the bladder 30 is used to provide buoyancy to the storage structure 10 as illustrated in FIG. 2, the bladder 30 engages the upper interior surfaces extending around the perimeter of the frame 12. The bladder 30 can be constructed of any suitable material including, but not limited to, aluminum or polymeric material.

The bladder 30 includes a fill port 32 configured to accept water (or other liquid) therein to provide ballast to the storage structure 10 to provide stability when the storage structure 10 is retaining equipment of a substantially weight. The bladder 30 includes a drain 34 to allow water to drain from the bladder to provide floatation or buoyancy when empty. The bladder 30 also includes a vent 36 to allow air to escape when adding water through the fill port 32 and to allow air to enter the bladder 30 when draining water through the drain 36, such that a vacuum is prevented within the bladder 30.

The storage structure 10 includes a plurality of floor or decking panels 40 that are secured to the inner upper surface of the frame 12, typically with nuts and bolts. However, other fastening devices including, but not limited to screws and interlocking abutting surfaces are also contemplated.

The decking panels 40 are typically of the same construction so that the panels 40 are interchangeable for ease of constructions. However, at least one panel 40 includes access panels 42 to the fill port 32 and the vent 36 to allow the bladder 30 to manipulated without having to remove the bladder 30 from the frame 12. As the bladder 30 is substantially open from the bottom, the drain 34 can be accessed by raising the storage structure 10 above the waterline.

The storage structure includes a skeleton or stud structure 50 that defines a shape of the structure. The structure 50 includes a plurality of spaced apart vertical studs 52 secured to the back beam 14, the left beam 16 and the right beam 24 and in the corners of the frame 12. A plurality of studs 52 are also secured to right beam 18. However, a substantially horizontal beam 54 is secured between a spaced apart studs 52 to provide an entryway 56 to an interior of the structure 10. Upper ends of the studs 52 are secured together with horizontal beams 58 that extend around a perimeter of the structure 50.

A roof line portion 60 of the structure 50 includes studs 62 secured to the horizontal beam 58 above the right beam 18. The studs 62 are secured to an upper beam 64 that is raised above the beam 58 a distance of the studs.

A left upper beam 66 is secured to the beam 58 above the left side beam 16 and trusses 68 are secured to the beams 64 and 66 to provide a roof line that slopes from the right side to the left side.

Referring to FIGS. 7-10, the storage structure 10 can includes walls 70, 72 and 74, that are constructed of panels 80 that are bolted or otherwise secured to the studs 52 and at least the trusses 68, the beam 64 at the exterior roof line and the frame 12. The wall 76 is includes similarly constructed panels 82 to the panels 80 that are secure to at least the studs 62, the upper beam 62 and the right side beam 18. The wall 76 also includes a partial panel 84 that defines an upper edge of a doorway 56.

Once the walls 70, 72, 74 and 76 are secured to the structure 50, roof panels 88 are secured to the upper beams 64 and 66 and the trusses 68 to provide a substantially waterproof structure.

A door 90 is then hingedly secured within the doorway 86 and can be locked. In some embodiments, one or more windows 92 and 94 can be utilized to provide natural light and ventilation into the structure 10. However, more or less windows can be utilized and in different locations.

Figure 11:
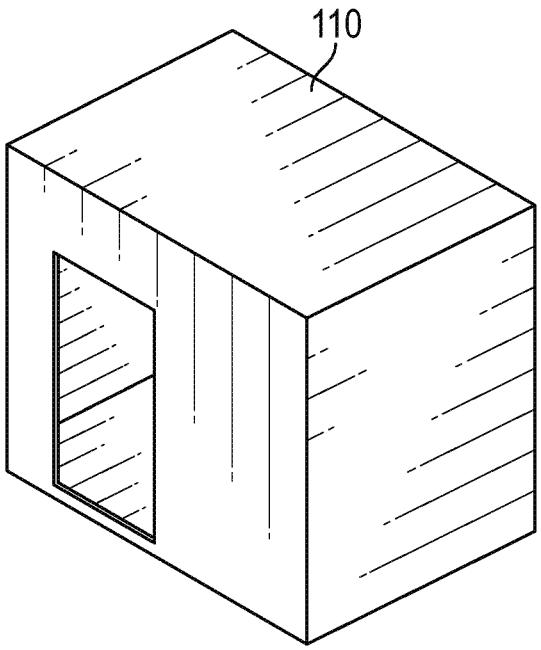
FIG. 11 is a perspective view of a one-piece shell of the structure.
Figure 12:
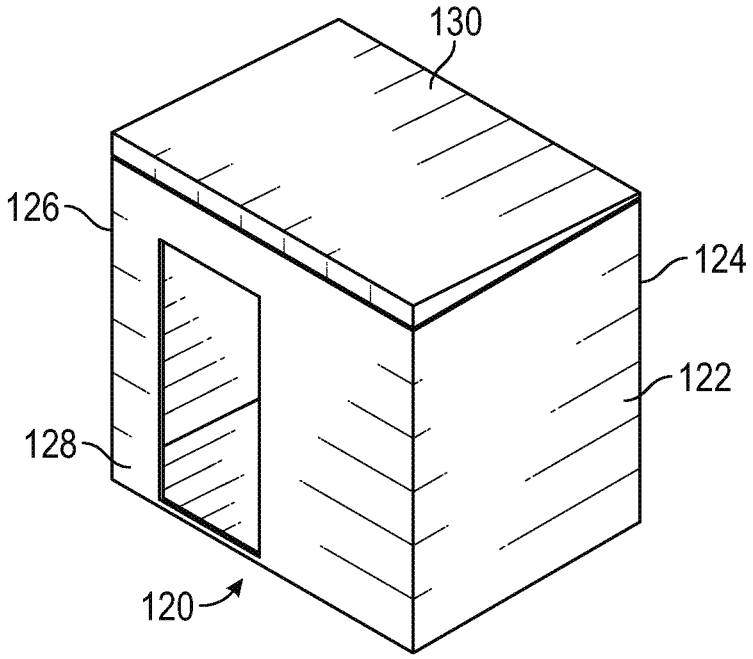
FIG. 12 is a perspective view of a five-piece shell of the structure.

As illustrated, the siding and roof of the structure can be constructed of panels. However, it is within the scope of the present disclosure to utilize a one-piece shell 110 as illustrated in FIG. 11 that is positioned over the skeleton or frame 50 or frame or by itself without the frame or skeleton. It is also within the scope of the present disclosure to utilize a five-panel construction 120 where the walls 122, 124, 126 and 128 are a single panel and the roof 130 is a single panel that can be secured to the skeleton or frame or alternative support itself without the skeleton or frame. A typical material of construction of the shell and panels include polymeric materials and metal materials including aluminum.

In the present disclosure, the studs 52 are utilized to mount or secure various items within the structure. By way of non-limiting example, the studs 52 can provide an interior surface for mounting or secure a sink, lights, storage brackets, live well, a pump for suppling water to the sink, bladder, the live well or a hose, a battery for storing electricity from the solar panel, lights, electrical connections, interior finish work, shelving and the like.

In alternative embodiments, the panels can include interlocking return bends that form the vertical seams 58 that aid in preventing water leakage. The return bends that form the seams that extend inwardly into the storage structure and provide interior surfaces for mounting items, as discussed above. Alternatively, the panels can include interlocking surfaces that are formed using a molding or extrusion process.

Optionally, the storage structure 10 can include one or more solar panel 100 secured to the side wall 76 where the solar panel 100 can provide electricity to the storage structure 10. However, any number of solar panels 100 can be secured to any of the exterior surfaces of the storage structure.

In some embodiments the solar panel 100 is used to charge a battery 132 within the storage structure 10. The battery 132 can be utilized to power a pump 132 to add water to the bladder 30 or running water for a sink 136 proximate a fish cleaning station 138. Further, the electricity from the solar panel 100 can be utilized to power electric lights 140 for visibility and any number of electric powered equipment including, but not limited to a charger, a speaker, and electric appliances.

In some embodiments, the frame 12 can be extended by adding length to the left and right beams 16 and 18 which allows additional panels to be utilized to increase the foot print of the storage structure 10.

Although the present disclosure has been described with reference to preferred embodiments, workers skilled in the art will recognize that changes may be made in form and detail without departing from the spirit and scope of the disclosure.

The invention claimed is:

1. A storage structure configured to be buoyant or retained above a water line the storage structure comprising:

a frame comprising:

a back beam comprising an upper interior surface and a lower interior surface spaced from the upper interior surface;

a left beam configured to be attached to the back beam, the left beam comprising an upper interior surface and a lower interior surface spaced from the upper interior surface;

a right beam configured to be attached to the back beam, the right beam comprising an upper interior surface and a lower interior surface spaced from the upper interior surface; and a front beam comprising an upper interior surface and a lower interior surface spaced from the upper interior surface, the front beam configured to be attached to the left beam and the right beam to form a substantially rectangular configuration, wherein prior to a last of the beams being secured together an interior space is accessible through an opening;

a plurality of spaced apart joists attached to the left beam and the right beam, wherein the plurality of spaced apart joists are located below the interior space; and a bladder configured to be positioned into the interior space though the opening wherein the bladder is sized to be retained within the interior space whether the frame is above the water line such that the bladder is configured to engage the lower interior surfaces of the back, left, right and front beams or the frame is below the water line wherein when the bladder is configured for use as buoyancy, the bladder is configured to engage the upper interior surfaces of the back, left, right and front beams, and wherein when the bladder is configured for use as ballast, the bladder is configured to engage the lower interior surfaces of the back, left right and front beams, wherein the bladder includes a vent, a fill port and a drain wherein an amount of water within the bladder is manipulated to provide ballast or buoyancy to the storage structure;

at least one floor panel configured to be secured to the frame over the bladder;

side walls configured to extend from a perimeter of the floor panel, wherein one side wall includes a door for ingress and egress to the storage structure; and a roof configured to be attached to the side walls.

2. The storage structure of claim 1, and further comprising a plurality of legs configured to be attached to the frame proximate corners thereof wherein each of the legs is independently positionable to a first position to raise the bladder above a water line and engages the bottom interior surfaces of the back, left, right and front beams and a second position wherein the bladder engages the water and the upper interior surfaces of the back, left, right and front beams.

3. The storage structure of claim 2, wherein each leg comprises:

an upper portion configured to be secured to the frame; and a lower portion configured to move relative to the upper portion to adjust a length of each leg.

4. The storage structure of claim 3, wherein the lower portion is configured to telescope within the upper portion.

5. The storage device of claim 1, and further comprising:

a skeleton structure comprising a plurality of space apart vertical studs, wherein the side walls are configured to be secured to the plurality of spaced apart studs.

6. The storage device of claim 5, wherein the skeleton structure further comprising a slanted upper portion comprising a plurality of slanted studs to which the roof is configured to be secured.

7. The storage device of claim 1, wherein at least one floor panel comprises an access panel that is configured to be manipulated to provide access to the fill port and the vent of the bladder.

8. The storage device of claim 1, wherein the side walls comprise a plurality of panels.

9. The storage device of claim 1, wherein the roof comprises a plurality of panels.

10. The storage device of claim 1, wherein the side walls and roof are of a unitary construction.

11. The storage device of claim 1, and further comprising a solar panel configured to be attached to an exterior surface of one of the side walls.

12. A storage structure configured to be buoyant or retained above a water line the storage structure comprising:

a frame comprising:

a back beam comprising an upper interior surface and a lower interior surface spaced from the upper interior surface;

a left beam configured to be attached to the back beam, the left beam comprising an upper interior surface and a lower interior surface spaced from the upper interior surface;

a right beam configured to be attached to the back beam, the right beam comprising an upper interior surface and a lower interior surface spaced from the upper interior surface, a front beam comprising an upper interior surface and a lower interior surface spaced from the upper interior surface, the front beam configured to be attached to the left beam and the right beam to form a substantially rectangular configuration, wherein prior to a last of the beams being secured together an interior space accessible through an opening wherein the last beam is removably secured to two of the other beams; and a bladder configured to be removably retained within the interior space of the frame, the bladder including a vent, a fill port and a drain wherein an amount of water within the bladder configured to is manipulated to provide ballast when engaging the lower interior surfaces of the front, left, right and front beams or buoyancy along the water line when engaging the upper interior surfaces of the front, left, right and front beams to the storage structure, wherein the bladder is removable from the frame by removing the last beam to provide an opening through which the bladder can be removed;

at least one floor panel configured to be supported by the frame over the bladder;

side walls configured to extend from a perimeter of the floor panel, wherein one side wall includes a door for ingress and egress to the storage structure;

a roof configured to be attached to the side walls; and a plurality of legs configured to extend from the frame, each of the plurality of legs being independently adjustable in length, wherein when the plurality of legs is in a first position, the legs support the structure above the water line and wherein when the plurality of legs is in a second position, the bladder provides buoyancy to the structure to maintain the structure afloat.

13. The storage structure of claim 12, wherein each leg comprises:

an upper portion configure to be secured to the frame; and a lower portion that moves relative to the upper portion to adjust a length of each leg.

14. The storage structure of claim 13, wherein the lower portion is configured to telescope within the upper portion.

15. The storage device of claim 12, and further comprising:

a skeleton structure comprising a plurality of space apart vertical studs, wherein the side walls are configured to be secured to the plurality of spaced apart studs.

16. The storage device of claim 15, wherein the skeleton structure further comprises a slanted upper portion comprising a plurality of slanted studs to which the roof is configured to be secured.

17. The storage device of claim 12, wherein at least one floor panel comprises an access panel that is configured to be manipulated to provide access to the fill port and vent of the bladder.

18. The storage device of claim 12, wherein the side walls comprise a plurality of panels.

19. The storage device of claim 12, wherein the roof comprises a plurality of panels.

20. The storage device of claim 12, wherein the side walls and roof are of a unitary construction.

21. The storage device of claim 12, and further comprising a solar panel configured to be attached to an exterior surface of one of the side walls.

* * * * *